US005598924A

United States Patent [19]

McCann

[11] Patent Number: 5,598,924

[45] Date of Patent: Feb. 4, 1997

[54] SPANNER HOLDER

[75] Inventor: Francis E. McCann, Taichung Hsien, Taiwan

[73] Assignee: Chiro Tool MFG Corp., Taichung Hsien, Taiwan

[21] Appl. No.: 540,089

[22] Filed: Oct. 6, 1995

[51] Int. Cl.[6] ..... B65D 85/28

[52] U.S. Cl. ..... 206/372; 206/485; 211/70.6

[58] Field of Search ..... 206/372, 375–376, 206/485, 526; 211/70.6

[56] References Cited

U.S. PATENT DOCUMENTS

| | | | |
|---|---|---|---|
| 180,106 | 4/1957 | Seifert | 211/70.6 |
| 2,426,899 | 9/1947 | Pantalone | 206/485 |
| 3,837,477 | 9/1974 | Boudreau | 206/376 |
| 4,705,168 | 11/1987 | Ward | 206/376 |

FOREIGN PATENT DOCUMENTS

| | | | |
|---|---|---|---|
| WO81/00352 | 2/1981 | European Pat. Off. | 211/60 T |

*Primary Examiner*—Ted Kavanaugh
*Assistant Examiner*—Shian T. Lam
*Attorney, Agent, or Firm*—Renner, Otto, Boisselle & Sklar

[57] ABSTRACT

A spanner holder includes a plate member and a plurality of pairs of retaining members. The plate member has a front face and two opposite sides. The retaining members in each pair are formed on the front face at the opposite sides of the plate member and are aligned with one another. Each of the retaining members has a spring plate which extends from the front face. The spring plate has a distal edge which is connected to an intermediate portion of a top plate. The top plate is substantially parallel to the front face and has an abutting portion and a connecting portion which are formed at two sides of the intermediate portion of the top plate. The connecting portion has a press plate which extends downward and which is substantially parallel to the spring plate so that a receiving space is formed between the press plate and the spring plate of an adjacent retaining member.

3 Claims, 6 Drawing Sheets

SPANNER HOLDER

BACKGROUND OF THE INVENTION

1. Field of the Invention

This invention relates a spanner holder, more particularly to a spanner holder which can hold spanners releasably and securely therein.

2. Description of the Related Art

The improvement of the present invention is directed to a conventional spanner holder. Referring to FIG. 1, the conventional spanner holder is made of a hard plastic material and comprises a rectangular frame member 10. The upper end of the frame member 10 has a handle portion 11. A beam 12 is formed transversely at the intermediate portion of the frame member 10. The rear face of the beam 12 has a plurality of concave portions 13 formed therein. The lower end of the frame member 10 is formed with a wall 14. The front edge of the wall 14 has a plurality of notches 15 formed therein. Each of the open ends of the notches 15 has a retaining edge 16 extending transversely therefrom in order to close partially a corresponding one of the open ends of the notches 15. Each of the notches 15 is aligned with a respective one of the concave portions 13 of the beam 12. A plate member 18 is connected transversely to the rear face of the frame member 10 adjacent to the lower end of the same. A plurality of parallel convex spring strips 17 are formed on the plate member 18. Each of the spring strips 17 is located between a respective one of the concave portions 13 and a corresponding one of the notches 15. Therefore, the handle 52 of a spanner 50 can be positioned in one of the concave portions 13 and a corresponding one of the notches 15 such that the edge of the handle 52 is retained by the retaining edge 6 of the corresponding one of the notches 15, as best illustrated in FIG. 1, and is biased by one of the spring strips 17, as best illustrated in FIG. 2. The drawbacks of the conventional spanner holder are as follows:

(1) When the spanner 50 is inserted into or removed from the frame member 10, the spanner 50 must be rotated by an angle sufficient to permit the enlarged box end 51 of the spanner 50 to pass under the beam 12. Since the spaces between the concave portions 13 or the notches 15 are limited, especially when there is an adjacent spanner held in the frame member 10, rotation of the spanner 50 is somewhat difficult, thereby inconveniencing the user.

(2) The contact area of one of the edges of the spanner handles 52 and a corresponding one of the spring strips 17 is relatively small. Thus, the edges of the handles 52 are liable to slip off from the spring strips 17, and the spanner 50 cannot be positioned firmly in the conventional spanner holder.

SUMMARY OF THE INVENTION

Therefore, the objective of the present invention to provide a spanner holder which can overcome the drawbacks that are associated with the above mentioned prior art.

Accordingly, a spanner holder of the present invention comprises a plate member and a plurality of pairs of retaining members. The plate member has a front face and two opposite sides. The retaining members in each pair are formed on the front face at the opposite sides of the plate member and are aligned with one another. Each of the retaining members has a spring plate which extends from the front face. The spring plate has a distal edge which is connected to an intermediate portion of a top plate. The top plate is substantially parallel to the front face and has an abutting portion and a connecting portion which are formed at two sides of the intermediate portion of the top plate. The connecting portion has a press plate which extends downward and which is substantially parallel to the spring plate so that a receiving space is formed between the press plate and the spring plate of an adjacent retaining member.

Therefore, a handle of a spanner can be clamped in the receiving spaces between the press plates of the one of the pairs of retaining members and the spring plates of an adjacent pair of retaining members such that the edge of the handle bears against the abutting portions of the one of the pairs of retaining members. Because the contact area of the spring plate and the press plate and two side faces of the spanner handle is larger than that of the edge of the spanner handle and the spring strip of the conventional spanner holder, the spanner can be clamped firmly in the spanner holder.

BRIEF DESCRIPTION OF THE DRAWINGS

Other features and advantages of this invention will become apparent in the following detailed description of the preferred embodiment of this invention with reference to the accompanying drawings, in which.

DETAILED DESCRIPTION OF THE PREFERRED EMBODIMENT

Figure 1:
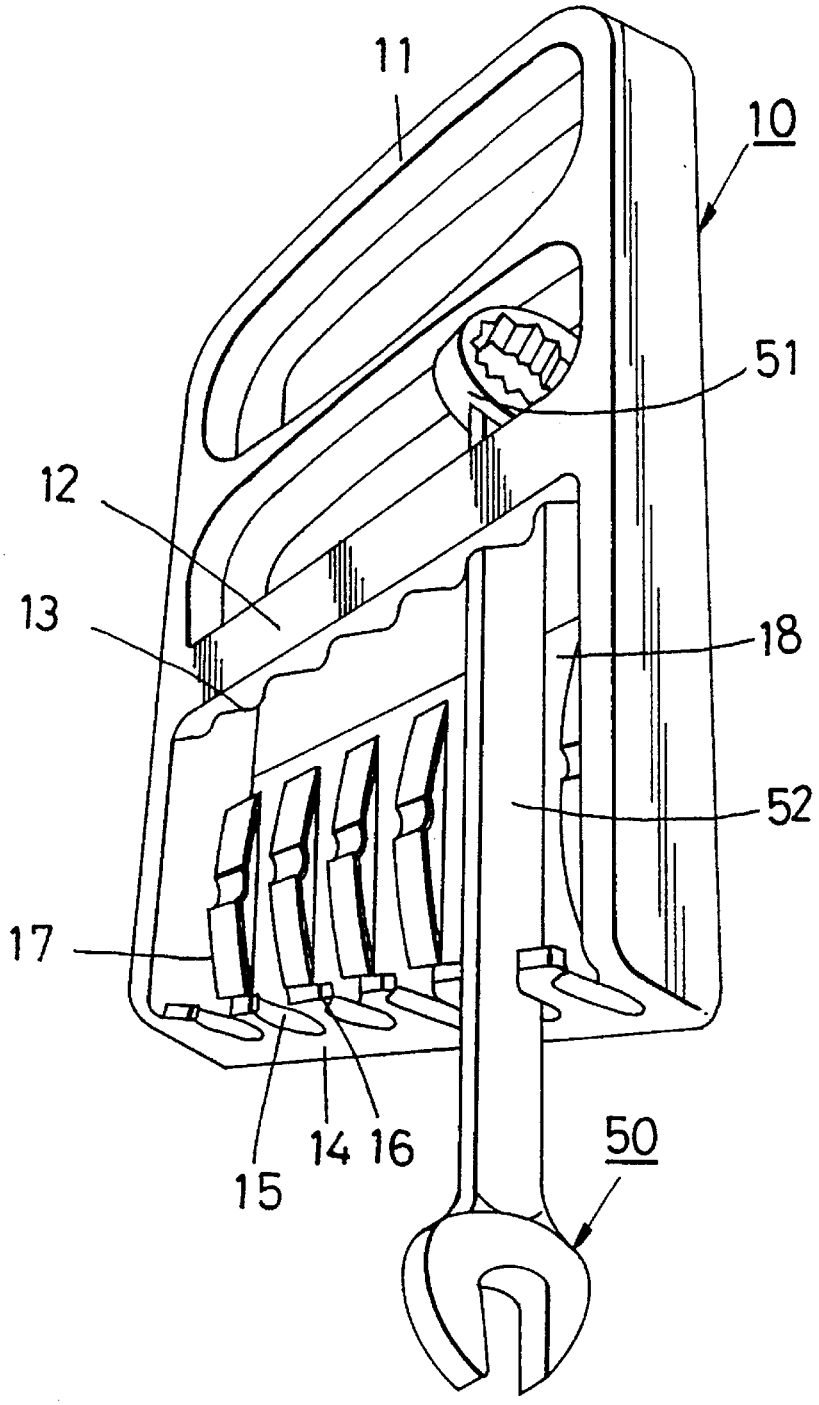
FIG. 1 PRIOR ART
FIG. 1 is a perspective view of a conventional spanner holder.
Figure 2:
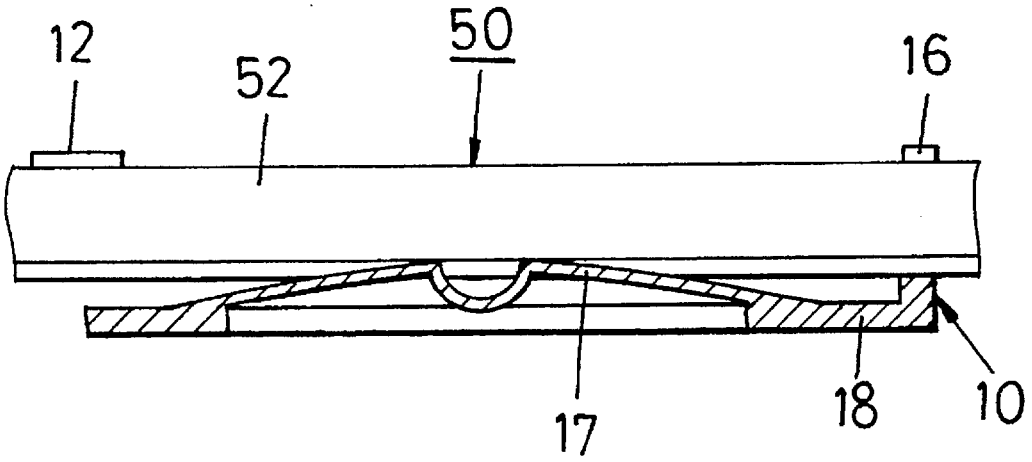
FIG. 2 PRIOR ART
FIG. 2 is a fragmentary sectional view of the conventional spanner holder of FIG. 1.
Figure 3:
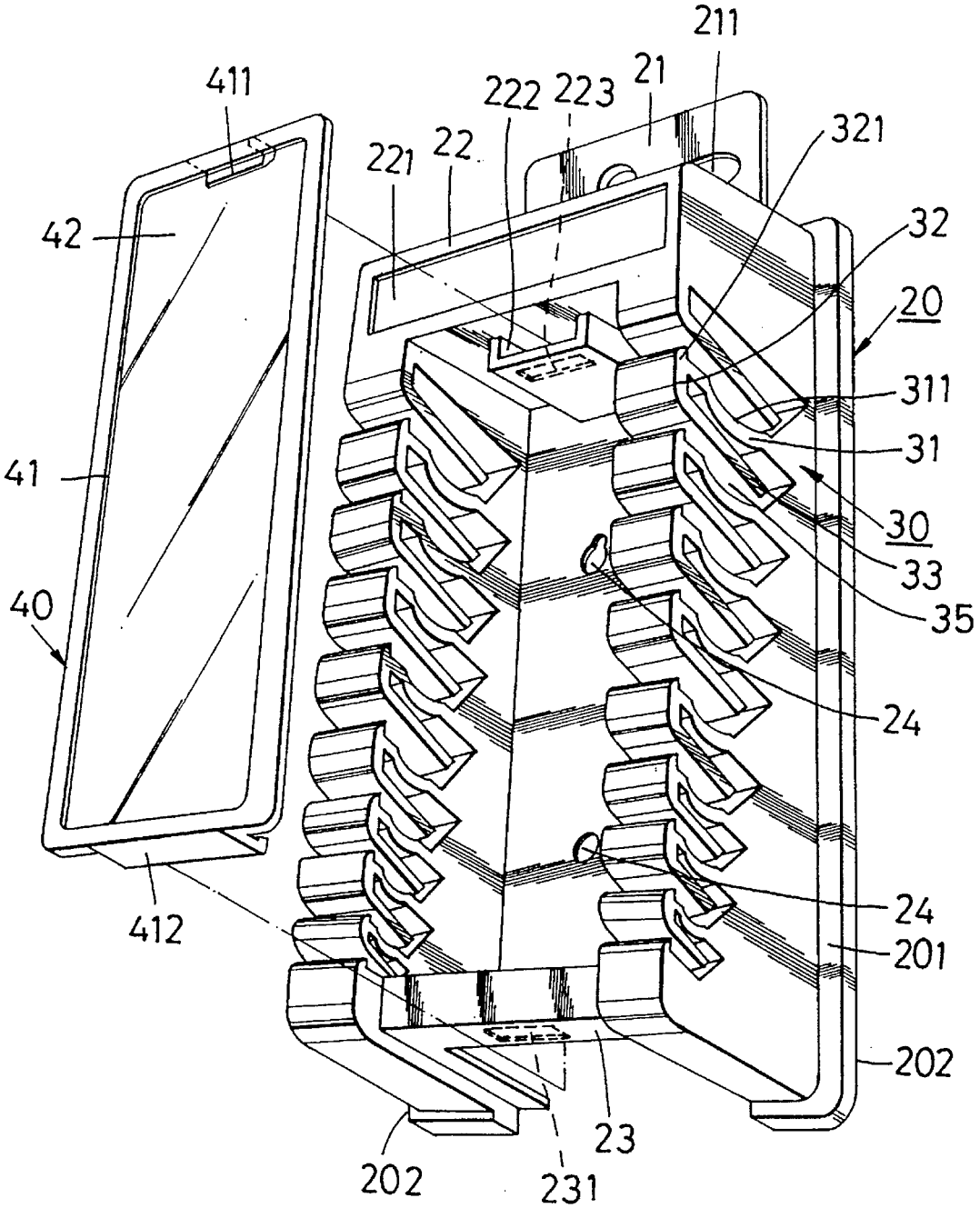
FIG. 3 is an exploded perspective view of a preferred embodiment of a spanner holder according to the present invention.

Referring to FIG. 3, a preferred embodiment of a spanner holder of the present invention is shown to comprise a plate member 20, a plurality of pairs of retaining members 30 and a cover plate 40.

The upper end of plate member 20 has a hanging portion 21 which is formed with an opening 211 for grasping and hanging purposes. Upper and lower projections 22 and 23 are formed adjacent to the upper and lower ends of the plate member 20. The front face of the upper projection 22 has a cavity 221 in which a label or a description card may be disposed for illustrative purposes. The lower portion of the upper projection 22 has a U-shaped plate 222 which is formed with a transverse slot 223. A retaining slot 231 is formed in the lower projection 23. The plate member 20 has two holes 24 which can be used for fixing purposes. For example, two screws (not shown) may pass through the holes 24 to secure the plate member 20 to a wall or a fixture.

Figure 5:
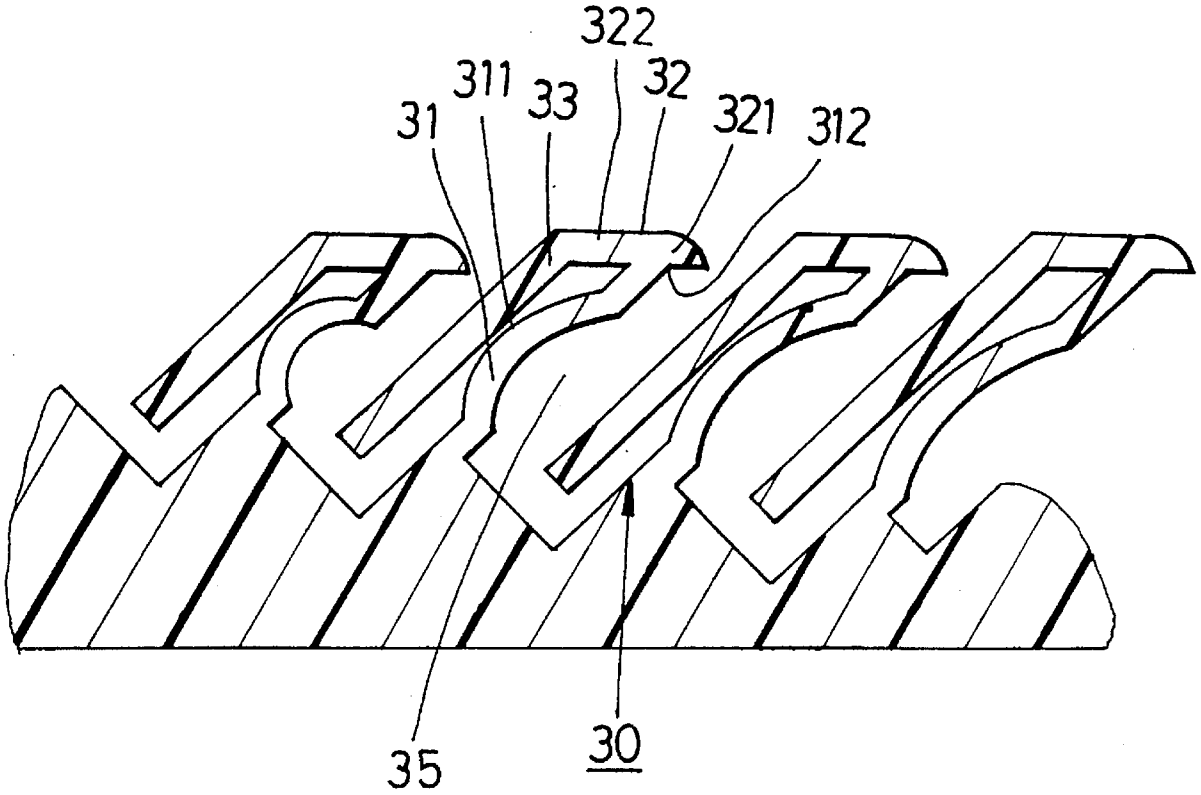
FIG. 5 is a fragmentary cross-sectional schematic view illustrating the configuration of the retaining members of the spanner holder of the present invention.

With reference to FIGS. 3 and 5, the retaining members 30 in each pair are formed on the front face 201 at the opposite sides 202 of the plate member 20 and are aligned with one another. Each of the retaining members 30 has a spring plate 31 which extends from the front face 21. Each of the spring plates 31 inclines upwardly with respect to the front face 21 of the plate member 20 at an angle of about 30°. The spring plate 31 has a concave portion 311 which is formed at the intermediate portion thereof in order to increase the resiliency of the spring plate 31. The spring plate 31 has a distal edge 312 which is connected to the intermediate portion of a top plate 32. The top plate 32 is substantially parallel to the front face 21 and has an abutting portion 321 and a connecting portion 322 which are formed at two sides of the intermediate portion of the top plate 32. The connecting portion 322 has a press plate 33 which extends downward and which is substantially parallel to the spring plate 31 so that a receiving space 35 is formed between the press plate 33 and the spring plate 31 of an adjacent retaining member 30.

The cover plate 40 has a surface area which generally equals that of the plate member 20 and includes a rectangular transparent plate 42 and a frame member 41 fixed to the periphery of the transparent plate 42. The upper and lower ends of the frame member 41 have two hook members 411, 412 which are adapted to engage respectively the transverse slot 223 and the retaining slot 231 in order to secure the cover plate 40 to the plate member 20.

Figure 4:
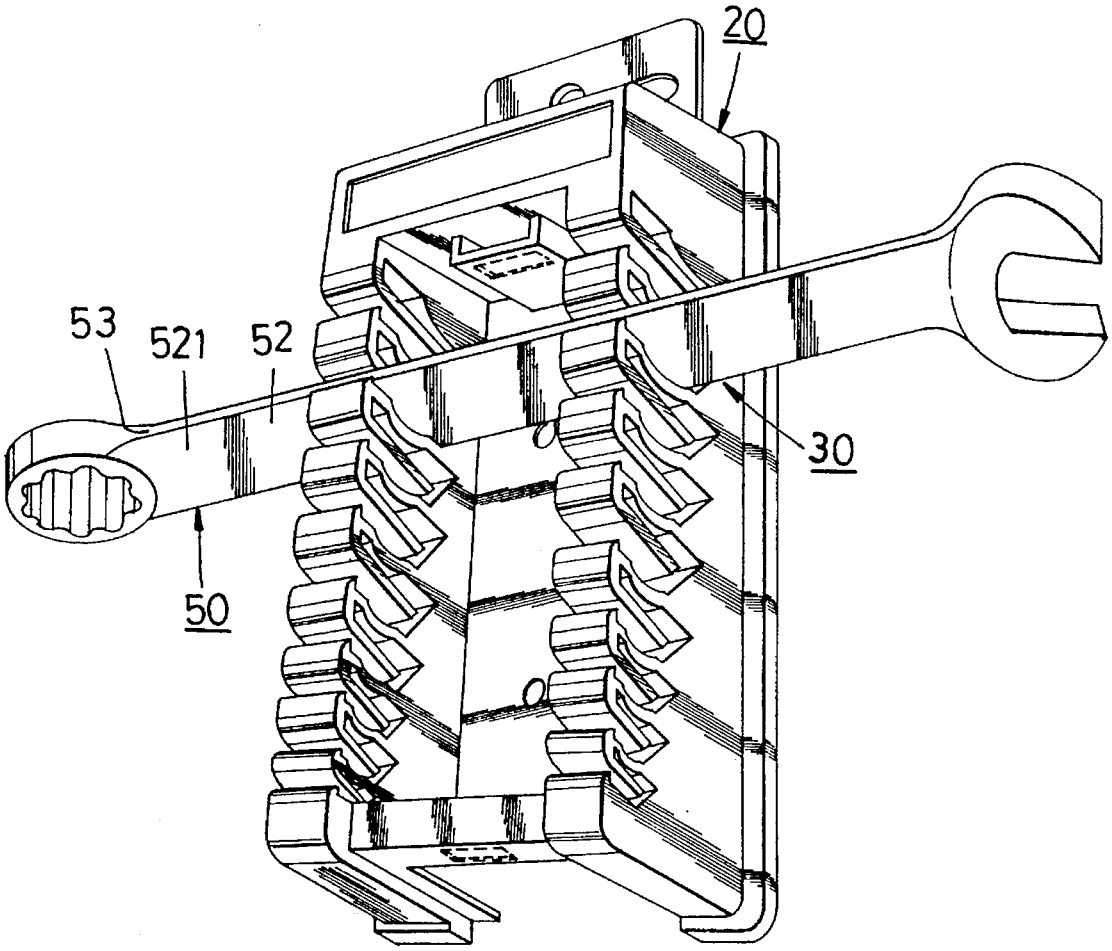
FIG. 4 is a perspective schematic view illustrating how a spanner is held in the spanner holder of the present invention.
Figure 6:
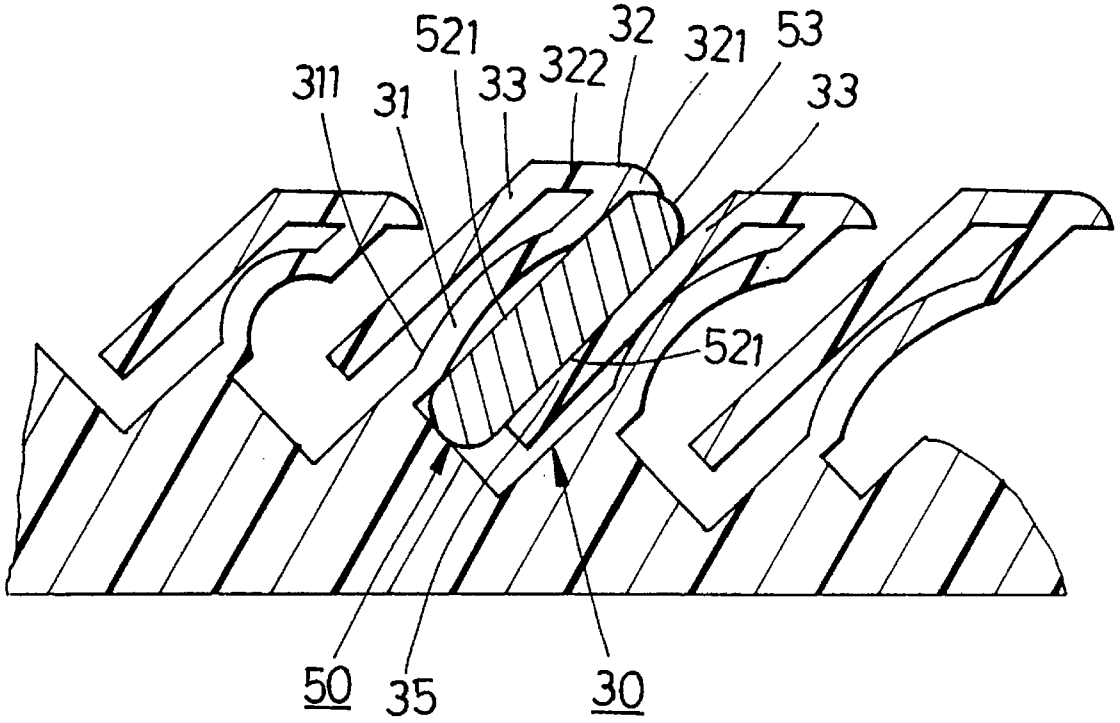
FIG. 6 is a fragmentary cross-sectional schematic view illustrating how a spanner is held by the retaining members of the spanner holder of the present invention.

In use, with reference to FIG. 4, the handle 52 of a spanner 50 is inserted transversely into the receiving spaces 35 of one of the pairs of retaining members 30 in order to force the press plates 33 of the retaining members 30 to move toward the spring plates 31. Therefore, the two side faces 521 of the handle 52 can be clamped resiliently between the press plates 33 of one of the pairs of retaining members 30 and the spring plates 31 of an adjacent pair of retaining members 30 due to the biasing forces of the press plates 33 and the spring plates 31, as best illustrated in FIG. 6. At the same time, the edge 53 of the handle 52 bears against the abutting portions 321 of one of the pairs of retaining members 30 in order to position the spanner 50 in the receiving spaces 35. In addition, because the contact area of the spring plate 31 and the press plate 33 and two side faces 521 of the handle 52 is larger than that of the edge of the spanner handle and the spring strip of the conventional spanner holder, the spanner 50 can be clamped firmly in the spanner holder of the present invention.

The spanner 50 may be detached from the retaining members 30 by depressing the press plates of one of the pairs of retaining members 30 in order to allow the edge 53 of the handle 52 to disengage from the abutting portions 321 of the retaining members 30. It is noted that the spanner 50 need not be rotated by an angle when being detached from the retaining members 30. Therefore, the spanner 50 can be easily inserted into and detached from the retaining members 30 without encountering hindrance from the other parts of the spanner holder and/or an adjacent spanner which is held in the spanner holder.

In the preferred embodiment, the length of the spring plates 31 decreases gradually from the topmost pair of retaining members 30 to the lowermost pair of retaining members 30. Therefore, the retaining members 30 can be used to hold spanners of different sizes, that is, spanners which have different widths at their handles.

Since the spanners 50 are disposed angularly with respective to the plate member 20 when the plate member 20 is hung on a wall, the specific sizes of the spanners 50 can be exposed to and seen by the user. Therefore, the user can conveniently find the desired spanner.

With this invention thus explained, it is apparent that numerous modifications and variations can be made without departing from the scope and spirit of this invention. It is therefore intended that this invention be limited only as indicated in the appended claims.

I claim:

1. A spanner holder, comprising:

a plate member having a front face and two opposite sides;

a plurality of pairs of retaining members, said retaining members in each pair being formed on said front face at said two opposite sides of said plate member and aligned with one another, each of said retaining members having a spring plate which extends from said front face, said spring plate having a distal edge which is connected to an intermediate portion of a top plate, said top plate being substantially parallel to said front face and having an abutting portion and a connecting portion which are formed at two sides of said intermediate portion of said top plate, said connecting portion having a press plate which extends downward and which is substantially parallel to said spring plate so that a receiving space is formed between said press plate and said spring plate of an adjacent retaining member;

whereby, a handle of a spanner can be clamped in said receiving spaces between said press plates of one of said pairs of retaining members and said spring plates of an adjacent pair of retaining members such that an edge of said handle bears against said abutting portions of said one of said pairs of retaining members.

2. A spanner holder as claimed in claim 1, wherein each of said spring plates has a concave portion which is formed at an intermediate portion thereof.

3. A spanner holder as claimed in claim in claim 1, wherein each of said spring plates inclines with respect to said front face of said plate member at an angle of 30°.

* * * * *